US005235785A

United States Patent [19]

Kurak et al.

[11] Patent Number: 5,235,785

[45] Date of Patent: Aug. 17, 1993

[54] APPARATUS AND METHOD FOR SHARPENING A CLIPPER BLADE

[76] Inventors: Thomas R. Kurak, 15001 Sunfish Lake Blvd.; Russell D. Radloff, 15720 Nowthen Blvd., both of Ramsey, Minn. 55303

[21] Appl. No.: 868,733

[22] Filed: Apr. 14, 1992

Related U.S. Application Data

[63] Continuation of Ser. No. 588,596, Sep. 26, 1990, abandoned, which is a continuation of Ser. No. 458,605, Dec. 29, 1989, abandoned, which is a continuation of Ser. No. 294,383, Jan. 6, 1989, abandoned.

[51] Int. Cl.[5] ..... B24B 3/52

[52] U.S. Cl. ..... 51/285; 51/211 R; 51/DIG. 6; 76/82

[58] Field of Search ..... 51/285, 209 DL, 209 R, 51/206 R, 206 P, 109 R, 109 BS, 158, 211 R, 211 H, 212, DIG. 6, 204, 181 R; 76/81-88

[56] References Cited

U.S. PATENT DOCUMENTS

| | | | |
|---|---|---|---|
| 1,059,566 | 4/1913 | Rodgers | 51/211 R |
| 2,675,656 | 4/1954 | Riedler | 51/285 |
| 2,762,175 | 9/1956 | Kramer | 51/285 |
| 4,060,941 | 12/1977 | Wahlstrom | 41/211 H |

FOREIGN PATENT DOCUMENTS

| | | | |
|---|---|---|---|
| 0329993 | 4/1920 | Fed. Rep. of Germany | 51/209 R |
| 0248563 | 2/1948 | Sweden | 51/211 H |

*Primary Examiner*—Robert A. Rose
*Attorney, Agent, or Firm*—Lawrence M. Nawrocki

[57] ABSTRACT

A plate device (22) and method for manually sharpening clipper blades (12). The plate (22) has an upper, rough sharpening surface (20) to which an abrasive sharpening compound (28) is applied. The compound (28) is applied as a thin film (32) covering substantially the full rough sharpening surface (20). A plurality of annular, concentric troughs or recesses (34) are formed in the surface (20). Compound (28) in excess of that necessary to form the thin film (32) can seep into these recesses (34). The rough sharpening surface (20) is domed to form a convex processing surface (20).

4 Claims, 1 Drawing Sheet

APPARATUS AND METHOD FOR SHARPENING A CLIPPER BLADE

This is a continuation of copending application Ser. No. 07/588,596 filed on Sep. 26, 1990, now abandoned, which is a continuation of application Ser. No. 07/458,605 filed on Dec. 29, 1989, now abandoned, which is a continuation of application Ser. No. 07/294,383 filed on Jan. 6, 1989 now abandoned.

TECHNICAL FIELD

The present invention deals broadly with the field of sharpening cutting instruments. More specifically, however, the invention deals with technology for sharpening cutting blades of an appliance used for shearing or grooming animals. The preferred embodiment of the invention is directed to the sharpening of such an appliance wherein cutting is effected by movement of a sliding cutting blade, having a plurality of teeth, across a fixed cutting blade, having a similar plurality of teeth.

BACKGROUND OF THE INVENTION

There can be little doubt that animal husbandry is an essential aspect of contemporary life. Wool shorn from sheep raised for that purpose goes into garments and accessories which function to keep the wearer warm even in very low temperatures. Light-weight wool garments also function to afford to the wearer stylishness and a contemporary appearance. Wool garments, therefore, prove not only functional, but aesthetically appealing also.

A first step in the manufacture of such garments is the removal of the wool fiber from the sheep. In order to maximize efficiency and economy, a sharp and reliable pair of clippers is necessary.

While it can be seen that clippers serve an important function in a practical operation such as the weaving of woolen goods, they are also an important implement employed in other endeavors involving animals. For example, such appliances are important tools to one who raises and displays show horses. Certainly, numerous other applications also exist where the fur or hair of an animal is to be shorn for some intended purpose.

Because of the coarseness and the strength of animal hair, clipper blades, typically, become dull after very few operations. In some cases, a newly sharpened appliance can have achieved a level of deterioration after only one use in cutting, for example, the mane and tail of a horse so that it becomes necessary to resharpen the cutting blades prior to the appliance being used again. As previously indicated, efficiency is important, and dull blades cause the efficiency to deteriorate significantly.

Commercial services are available for sharpening clipper blades. These services tend to be relatively expensive, however. As one will understand, in view of the frequency at which blades must be sharpened, significant monetary expenditures and time investment can be involved in the business of, for example, raising and displaying show horses.

Certainly, one can attempt to sharpen clipper blades himself rather than sending them out to a commercial sharpening service. Devices and methods known in the prior art, however, make this difficult and, potentially, even more costly than sending a clipper out to a sharpening service. This is so, since someone who is not knowledgeable can damage the blades in his attempt to sharpen them.

FIG. 8 illustrates one tooth of a moveable clipper blade as shown in cross-section. Such a tooth moves laterally as the blade of which it is a part is made to reciprocate. As the moveable blade reciprocates from right to left, the lower surface of the tooth, at sides of which cutting edges are defined, interacts with a corresponding surface or surfaces of teeth of a fixed blade. The cutting edges of upper teeth cause strands of hair to be squeezed between those teeth and cutting edges of lower teeth to effect clipping.

The intent of sharpening is to render cutting edges acute (that is, without any rounding). As a result, interfacing surfaces of the upper and lower blades will move, substantially, in a common plane and the pointed edges of the teeth will closely pass each other to effect a maximum efficiency cutting operation.

FIG. 8 illustrates a tooth 10 of a moveable blade 12, the lower surface of which is substantially planar. As will be able to be understood in view of this disclosure, it would be undesirable to have such a surface 14 with any measure of convexity. The more convexity existing in such a lower surface 14 of a tooth 10 of the upper, moveable blade 12, the duller of the cutting edge of the tooth 10 will be.

Conversely, the lower surface 14 of a tooth 10 of an upper blade 12 might, appropriately, have a measure of concavity, as indicated by phantom line at 16, and still function well for its intended purpose. In fact, if a measure of concavity 16 is provided, the cutting teeth 10 might be even sharper than they would otherwise be. In any event, however, the provision of a measure of concavity would also retard the rapid rendering of the teeth 10 dull, since, even if some of the tooth edge 18 becomes worn, there will still be a tendency to provide an acute angle at the tooth's edge 18.

When novices attempt to sharpen blades, they, typically, fail to recognize that, as they move a blade 12 over a sharpening surface 20, there is a tendency to wobble the blade 12 over the sharpening surface 20 as sharpening is being attempted. As a result, when the lower surface 14 of the tooth 10 is, initially, planar, there will be a tendency to render that surface 14 somewhat convex, and, when the tooth's lower surface 14 is initially provided with some measure of concavity 16, there is a tendency to diminish the degree of concavity. After a number of sharpening operations performed in this manner, the blades can be damaged so that they can be sharpened only by grinding a large portion of the blade surface. As a result, the blade life is significantly diminished.

Another problem in performing manual sharpening operations derives from the nature of abrasive sharpening compound used. It is essential that the compound be used sparingly or undesirabe damage can occur. Too much compound on the sharpening plate will result in a poor cutting edge on the blade's teeth.

It is to these problems and desirable dictates of the prior art that the present invention is directed. It is an apparatus and method which goes far to solve the problems described herein, and it also considers the desirable characteristics which prior experience dictates.

SUMMARY OF THE INVENTION

The present invention includes apparatus for manually sharpening a clipper blade. Typically, as previously discussed, such a clipper blade has a flat or concave surface which, during a sharpening evolution, is brought into engagement with a sharpening surface. The apparatus includes a sharpening member which has a face defining a sharpening surface. The sharpening surface face is provided with a network of recesses formed therein to receive and accommodate any excess abrasive sharpening compound placed on the sharpening surface by the user of the apparatus. Consequently, only a very fine film of the compound is actually present on the surface which is engaged by the clipper blade surface.

In a preferred embodiment, the recess network includes a plurality of annular troughs formed in the sharpening surface. It is envisioned that these troughs would be formed concentrically with respect to one another.

The apparatus also contemplates employment of a disk-like sharpening member. Such a member has, on one side, a first face defining a rough sharpening surface. It is this surface in which the annular troughs can be formed.

The disk-like member has, on an opposite side thereof, a second face defining a polishing surface. It is contemplated that the polishing surface would be smooth and would not have a trough network formed therein. Such a surface is intended to polish the clipper blades to a smooth, shiny finish.

In the preferred embodiment, the oppositely-facing, first and second faces of the disk-like plate are convexly arcuate. That is, in the preferred embodiment, both of the oppositely-facing surfaces are slightly "domed". Such a structure better facilitates the proper sharpening of clipper blades.

The present invention is an improved apparatus and method for manually sharpening clipper blades. More specific features, and advantages obtained in view of those features, will become apparent with reference to the DETAILED DESCRIPTION OF THE INVENTION, the appended claims, and the accompanying drawing figures.

Detailed Description of the Invention

Figure 1:
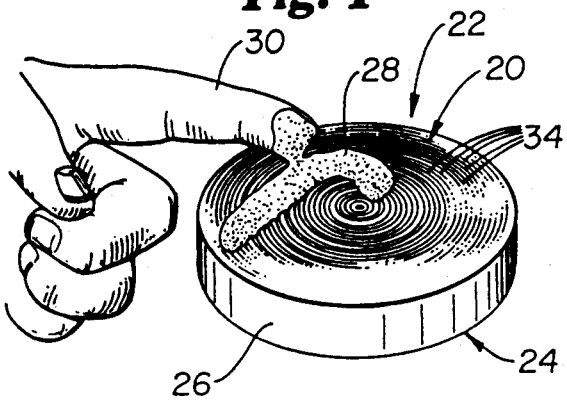
FIG. 1 is a perspective view of a preferred form of the invention showing an abrasive compound being applied to an upper, rough sharpening face of a sharpening member in accordance with the present invention.
Figure 2:
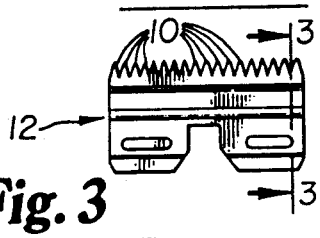
Fig. 2 PRIOR ART
FIG. 2 is a top plan view of a typical clipper blade as known in the prior art.
Figure 3:
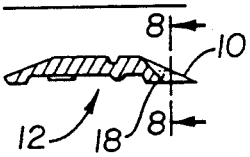
Fig. 3 PRIOR ART
FIG. 3 is a side sectional view of the clipper blade of FIG. 2 taken generally along the line 3—3 of FIG. 2.
Figure 5:
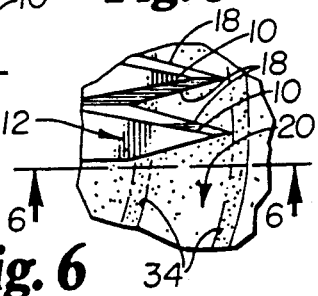
FIG. 5 is a fragmentary top plan view of selected elements of FIG. 4 slightly enlarged.
Figure 4:
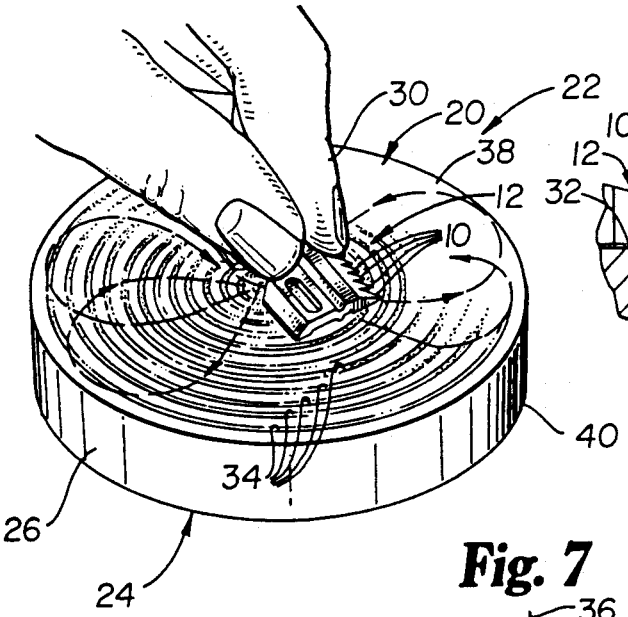
FIG. 4 is a perspective view showing the manner in which a user of the invention would perform the sharpening process.
Figure 7:
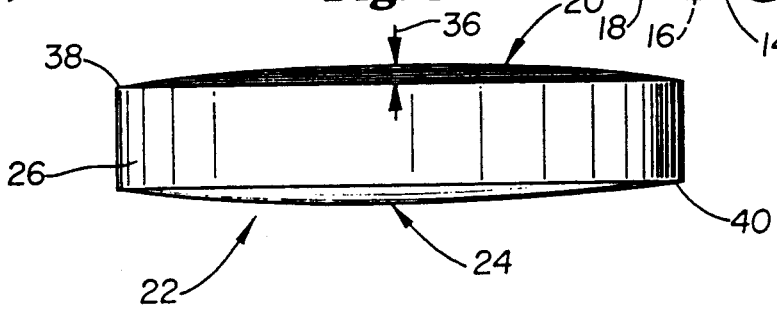
FIG. 7 is a side elevational view of the sharpening member in accordance with the present invention.

Referring now to the drawing wherein like reference numerals denote like elements throughout the several views, FIG. 1 illustrates apparatus 22 for sharpening a clipper blade 12 in accordance with the present invention. That figure, and FIGS. 4 and 7, illustrate a disk-like plate sharpening member. The member 22 is shown as having an upper, first face, defining a rough sharpening surface 20, and a lower, second face, defining a polishing surface 24. A side wall 26 defines a circumferential edge which constrains, within its boundaries, the upper and lower surfaces 20, 24.

Figure 6:
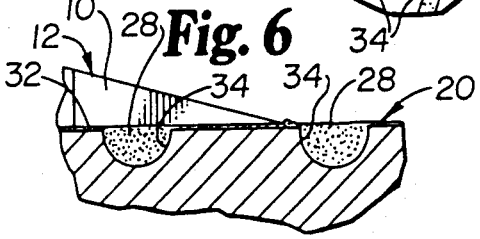
FIG. 6 is a side sectional view taken generally along the line 6—6 of FIG. 5 greatly enlarged.

As best seen in FIGS. 1, 4, and 6, the upper surface 20 is provided with a recess network. As seen in FIG. 1, the user of the implement applies a quantity of abrasive sharpening compound 28 to the rough sharpening surface 20. Using his finger 30, the user can smear the compound over substantially all of the rough sharpening surface face 20.

It is intended that only a very fine film 32 coat the sharpening surface 20. While the user might estimate a quantity of abrasive compound 28 that he would think would barely cover the surface 20, it has been found that there is a tendency to underestimate the ability of the compound 28 to be thinned out to sufficiently cover the entire surface 20. Consequently, there tends to be an excess of compound 28 applied to the disk-like plate rough sharpening surface.

It is for this purpose that the recess network is provided. As seen in FIG. 6, the excess compound can seep into the recesses 34 and be accommodated thereby so that only the desirable fine film 32 will coat the actual surface 20 engaged by a clipper blade 12 to be sharpened.

It will be understood also, however, that the recesses 34 can also function as reservoirs from which additional compound 28 can be drawn as necessary. If numerous blades are being sharpened, the film 32 initially being applied on the treatment surface 20 can diminish as successive blades are sharpened. As this occurs, additional compound 28 can be drawn from the recesses 34 by the user exerting more pressure on the face 20 of the plate 22 to "squeeze" some of the compound in the recesses 34 upwardly. that compound 28 can then be applied to the treatment surface 20.

As seen FIG. 7, the upper surface 20 of the disk-like plate 22 is "domed". That is, the surface 20 is convex and has a greater height at its center rather than at its periphery.

It will be understood that the degree of doming is exaggerated in FIG. 7. Typically, the diameter of the disk-like plate 22 is between four and five inches. The rise of the dome, however, as illustrated by reference numeral 36 is only on the order of 0.002 inches.

As seen in FIG. 7 also, the lower, polishing surface 24 can also be provided with a domed construction. The rise of the lower dome, it is anticipated, would be the same as that of the upper dome.

FIG. 7 illustrates the lower, polishing surface 24 without a recess network. This would be so, since the lower surface 24 is the "fine" side of the plate 22 and is used for polishing the blade 12 previously sharpened on the upper surface 20. The polishing side 24 of the plate 22 is intended to bring the blade 12 to a smooth, shiny finish.

In use, the disk-like plate 22 is placed on a surface with the side having the annular troughs 34 comprising the recess network facing upwardly. A small amount of sharpening compound 28 is applied to the rough sharpening surface 20 so that only a thin film 32 will overlie the surface 20 engaged by the blade 12 to be sharpened. As previously indicated, if any compound 28 in excess of that necessary to accomplish the sharpening function is applied, the residue will seep into the concentric annular troughs 34. As previously indicated also, eventually the full rough sharpening surface 20 should be coated.

It is intended that a water-solluble, abrasive, sharpening compound 28 be employed. Consequently, if necessary or desirable, a small amount of water may be added on the surface 20 to which the compound 28 has been applied. Such an addition will function to better create the desirable film 32 over the processing surface 20.

After a clipper has been disassembled sufficiently so that the moveable, upper blade 12 has been detached, that blade 12 is grasped as indicated in FIG. 4. That is, a side of the blade 12 intended to be brought into engagement with the sharpening surface 20 to effect sharpening is so engaged. Typically, the user of the implement would grasp the opposite side of the blade 12 between his thumb and index finger.

Figure 8:
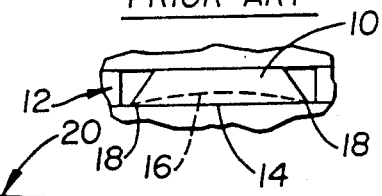
Fig. 8 PRIOR ART
FIG. 8 is a sectional view taken generally along the line 8—8 of FIG. 3.

Sharpening is effected by moving the blade 12 in a figure-8 pattern over the domed rough sharpening surface 20 of the plate 22. This is done repetitively, and, on each pass, the blade 12 should be run over the peripheral edge 38 enclosing the sharpening surface 20. The working will, thereby, be distributed over a maximum area of the plate 22, and plate life will be maximized.

Similarly, the sharpening plate 22 should be rotated regularly during the sharpening process. The intent is to effect even wear of the plate rough sharpening surface 20. This will result in view of the axis of the figure-8 pattern being rotated.

Because of the doming of the surface 20, the blade teeth 10 will tend to be worked most centrally so as to encourage the creation of a concavity in each tooth 10 and better defined cutting edges 18.

It has been found that about fifty figure-8 passes has been sufficient to adequately sharpen most blades 12. It will be understood, however, that sufficient sharpening may be accomplished with less passes, and that it might be necessary to make in excess of fifty passes if the blade conditions dictate.

After sufficient passes have been made, the blade 12 should be dipped in water. Excess compound can be wiped off and the blade 12 inspected. The sharpened edges 18 of the teeth 10 should have an even, dull gray finish. If the color is not substantially uniform, or if pits or wear marks are still apparent, additional figure-8 passes can be made.

After it is apparent that the color is consistent, the disk-like plate 22 should be inverted. The blade 12 can then be polished by making figure-8 passes over the polishing surface 24 of the plate 22. It has been found that about forty of such figure-8 passes is appropriate in the case of most blades.

As in the case of the rough sharpening processing, the blade 12 should be run slightly passed the periphery 40 of the surface 24. Similarly, the disk-like plate 22 should be rotated regularly.

In most clippers, a stationary blade is provided as well as a reciprocatorily-moveable blade. When such is the case, the stationary blade should be detached from the clipper implement and sharpened and polished in the same manner as was the other blade. The clipper can, thereafter, be reassembled for future use.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A method of manually sharpening a blade of a clipper implement intended to be used in the grooming of horses, wherein said blade includes a plurality of teeth, each tooth normally having a concave surface to be brought into engagement with a sharpening surface for sharpening, comprising the steps of:

(a) providing a sharpening member having a first convexly arcuate face defining a sharpening surface and a second convexly arcuate face defining a polishing surface, said first and second convexly arcuate faces facing in opposite directions;

(b) applying a thin film of sharpening compound over the entire sharpening surface of the sharpening member;

(c) diluting the sharpening compound applied to the sharpening surface by adding a small amount of water in order to facilitate the creation of a thin film of sharpening compound on the sharpening surface;

(d) lightly rubbing the clipper blade surface over the sharpening surface of the sharpening member in a series of successive figure-8 passes;

(e) inverting the sharpening member; and (f) lightly rubbing the clipper blade surface over the polishing surface of the sharpening member in a series of successive figure-8 passes.

2. A method in accordance with claim 1 comprising a further step of regularly rotating the sharpening member as said figure-8 passes are made.

3. A method in accordance with claim 1 wherein the sharpening surface of the sharpening member is defined by a peripheral edge, and further comprising the step of running the clipper blade being sharpened over the edge defining the sharpening surface at the upper and lower extremes of each figure-8 pass.

4. Apparatus for manually sharpening a blade of a clipper implement to be employed for grooming horses, wherein said blade includes a plurality of teeth, each tooth being normally provided with a concave surface intended to be brought into engagement with a sharpening surface for sharpening, comprising:

(a) a disk-like plate sharpening member including:

(i) a first face having a plurality of concentric annular troughs formed therein, said first face defining a rough sharpening surface; and (ii) a second face, facing in a direction opposite a direction in which said first face faces, said second face defining a polishing surface;

(b) wherein both said first face and said second face are convexly arcuate to a degree wherein the measure of convex arcuity is the same as the measure of concavity intended to be imparted to the teeth of said clipper blade.

* * * * *